US005544676A

United States Patent [19]

Derudder

[11] Patent Number: 5,544,676

[45] Date of Patent: Aug. 13, 1996

[54] LOOM REED WITH INTEGRAL DEFLECTOR HEALD FRAME

[75] Inventor: Carlos Derudder, Waterhoek, Belgium

[73] Assignee: N.V. Michel Van De Wiele, Kortrlik-Marke, Belgium

[21] Appl. No.: 329,422

[22] Filed: Oct. 27, 1994

[30] Foreign Application Priority Data

Oct. 28, 1993 [BE] Belgium ..... 9301163

[51] Int. Cl.[6] ..... D03D 49/62

[52] U.S. Cl. ..... 139/192; 139/21

[58] Field of Search ..... 139/189, 191, 139/192, 51, 52, 21, 37, 46; 28/205

[56] References Cited

U.S. PATENT DOCUMENTS

| | | | |
|---|---|---|---|
| 571,182 | 11/1896 | Adauison | 139/192 |
| 959,306 | 5/1910 | Buckler | 139/21 |
| 3,590,880 | 7/1971 | Kathriner | 139/192 |

FOREIGN PATENT DOCUMENTS

| | | | |
|---|---|---|---|
| 467307 | 7/1914 | France . | |
| 2688520 | 9/1993 | France . | |
| 293829 | 12/1913 | Germany . | |
| 2449974 | 4/1975 | Germany | 139/192 |
| 2823222 | 12/1979 | Germany . | |
| 760397 | 10/1956 | United Kingdom . | |

*Primary Examiner*—Andy Falik
*Attorney, Agent, or Firm*—Sughrue, Mion, Zinn, Macpeak & Seas

[57] ABSTRACT

A loom reed with integral deflector heald frame is designed to prevent yarns from becoming entangled during the weaving of carpets and/or velvets, in a face-to-face or pile wire weaving loom. The reed includes dents or drop wires wherein at least one drop wire (3) is made up of a staggered or offset front and rear part which are parallel to each other. The offset between the two parts is in the weft insertion direction relative to the front part (8) of the drop wire (3).

2 Claims, 4 Drawing Sheets

LOOM REED WITH INTEGRAL DEFLECTOR HEALD FRAME

BACKGROUND OF THE INVENTION

1. Field of the Invention

The present invention relates to a loom reed with inbuilt deflector heald frame, comprising a reed rail at the bottom, a reed cap at the top, and two side bars between which a number of parallel drop wires or dents are situated. Such a loom reed is fixed on a lay of a face-to-face or a pile wire weaving loom, in order to separate a number of pile warp threads from each other during the weaving of carpets and/or velvet with yarns which have a tendency to become entangled.

2. Description of the Prior Art

In face-to-face weaving with pile warp threads which have a great tendency to become entangled by the protruding filaments it is often necessary to separate those threads from each other again by providing a deflector heald frame in the zone between the harness containing the combined rows of upgoing and downgoing pile warp healds and the loom reed which moves to and from to beat up the weft or wefts.

Such a deflector heald frame consists of a number of wire healds provided with two eyes, one at the top, by means of which the wire healds are threaded on a rod, and one at the bottom, by means of which the wire healds are fixed by a rod to the lay behind the loom reed. The deflector heald frame is connected to the loom reed and thus moves along with the loom reed, so that the wire healds comb the pile warp threads apart, with the result that the pile warp threads are separated from each other again in each case.

The filament bridges occurring are thus combed out before they can build up very strong connecting bridges between the pile warp threads. The installation of such a deflector heald frame requires a certain amount of space in particular at the top behind the loom reed and at the bottom behind the loom lay, which beats up the weft after each pick. In order to be able to achieve such a fixing, the harness has to be pushed back about 3 cm. This displacement of the harness causes an increase in the lifts on the harness cords connected to the jacquard machine.

These greater lifts cause a greater strain on the pile warp threads, with the result that the shot frequency of the weaving loom is limited. The efficiency of the weaving loom is also reduced as a result.

Moreover, these wire or deflector healds are not capable of separating the pile warp threads from the foundation warp threads, so that pile warp threads can lie intertwined on the back of the carpet.

Another solution is to place a second loom reed slightly staggered in the weft insertion direction relative to the first loom reed, so that a number of pile warp threads can be combed out of each other again. Not only is this arrangement expensive and requires a second reed, but no room is generally provided on the lay of a weaving loom for fixing this second reed.

SUMMARY OF THE INVENTION

The object of the invention is to provide a loom reed which solves the problem posed. This object is achieved according to the invention by making the deflector heald frame and the loom reed integral, while the thickness of the reed rail is kept the same as that of a conventional loom reed.

For this purpose, each dent of the loom reed is provided with a recess which divides the dent, which is in one piece, into a front and a rear part, said rear part being staggered slightly parallel and laterally in the weft insertion direction relative to the front part.

The pile warp threads which have a tendency to become entangled are according to the invention separated from each other by the rear reed dent part in such a way that the filament bridges in the pile warp threads are combed out during the beating-up movement. The front part fulfils the function of a conventional reed, namely separating the warp yarn groups and beating up the wefts.

A first advantage of the invention is that the loom reed is sturdier and that the deflector heald dents are at the same time connected in one piece to the reed dents without any appreciable weight increase of the loom reed as a whole.

According to a special characteristic of the invention, at least one drop wire or dent is windowed, in other words, provided with an elongated recess.

An unexpected advantage of the invention is that the pile warp threads can be separated completely from the foundation warp threads, with the result that pile warp threads can no longer become interlocked under the binding warp threads, and with the result that the pile loops remain in a neat row between the binding warp threads, in other words, a clear back is obtained in the face-to-face weave.

These features and other features and special characteristics of the invention will emerge from the description which follows, with reference to the appended drawings, which show an embodiment of the invention by way of example which is in no way restricting.

BRIEF DESCRIPTION OF THE DRAWINGS

In these drawings the same reference symbols indicate identical or similar elements.

DESCRIPTION OF THE PREFERRED EMBODIMENT

Figure 3:
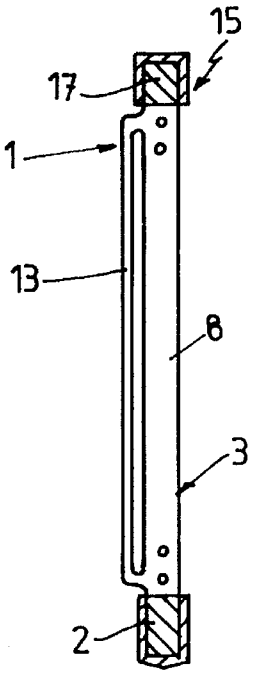
FIG. 3 is a vertical section along line III—III in the weaving device shown in FIGS. 1 and 2.
Figure 1:
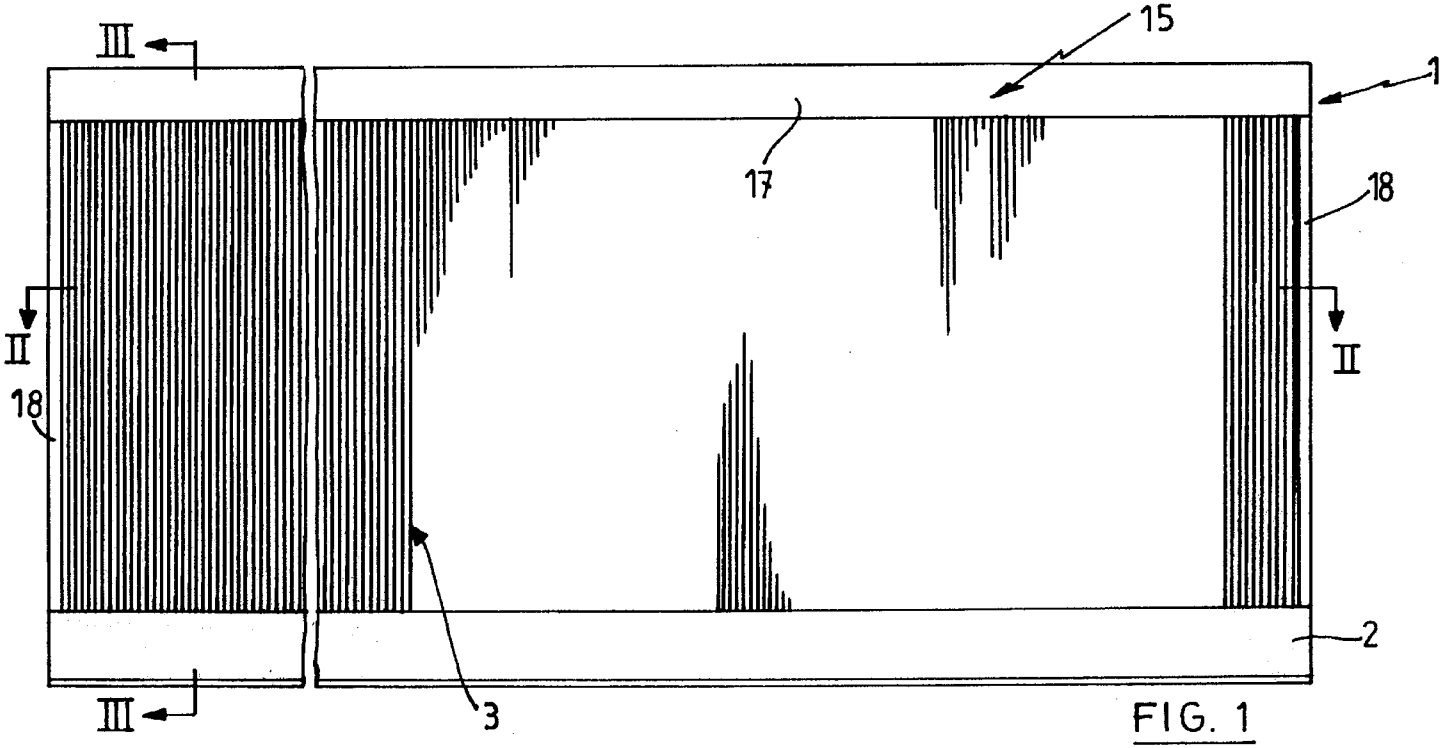
FIG. 1 is a front view of a loom reed device according to the invention.
Figure 2:
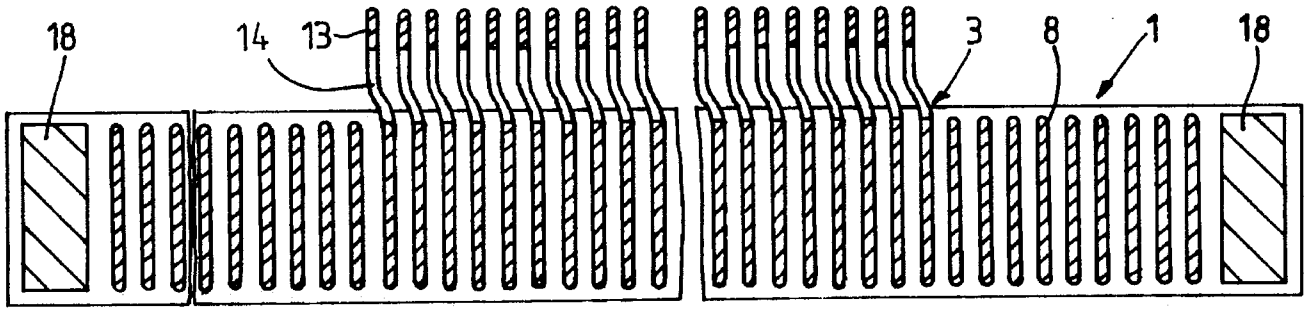
FIG. 2 is a horizontal section along line II—II, on a larger scale, in the loom reed shown in FIG. 1.
Figure 5:
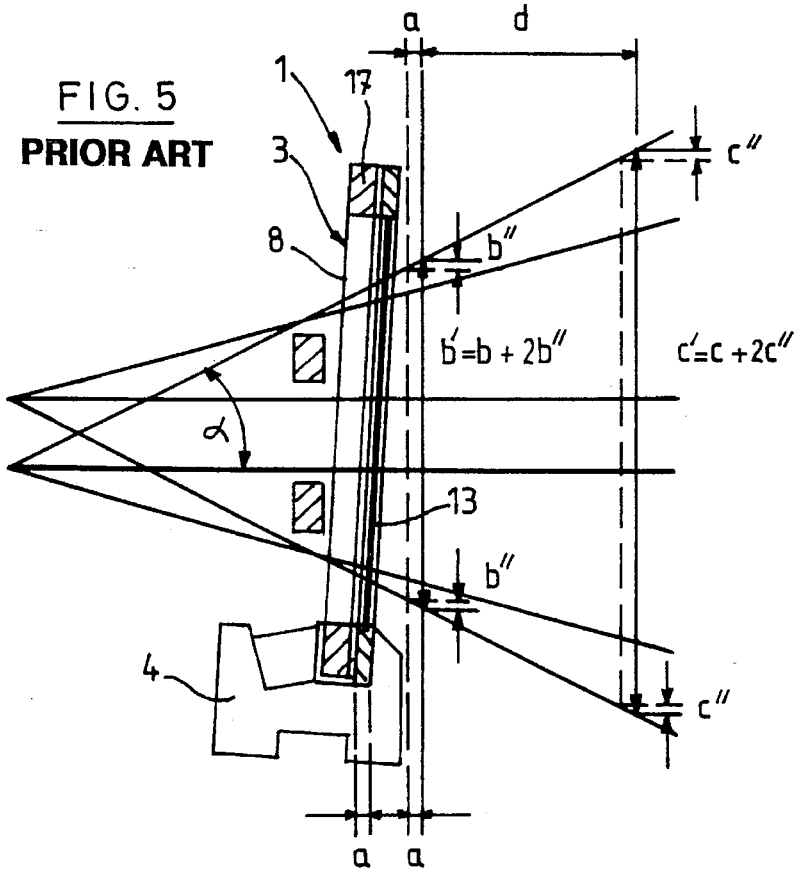
FIG. 5 PRIOR ART
FIG. 5 is a diagrammatic arrangement of a conventional double reed indicating the space taken up by the installation of a second loom reed.

As shown in FIG. 1, the loom reed 1 according to the invention is formed by a reed rail 2 at the bottom, a reed cap 17 at the top, and two side bars 18 between which a number of parallel drop wires or reed dents 3 are situated, in which warp threads (not shown) run parallel to the length of the fabric in a face-to-face or a pile wire weaving loom. The loom reed 1 keeps the groups of warp threads separate and beats up the weft threads or thread after each pick. The loom reed rail 2 is fixed on the loom lay 4 of the weaving loom. After each beating-up, a number of healds 6 in the harness 5 are raised, and a number of other healds 7 are lowered. The pile warp shed is formed in this way. The main weave frames then ensure the formation of the shed of tension and binding warp threads. The warp threads in this case form a specific shed angle in the case of certain lifts of the harness healds. FIG. 5 makes it clear that the lifts on the harness healds increase from b to b' if the harness 5 has to be pushed further backwards for the installation of a double reed in the weaving loom. The space taken up by the second reed is indicated by a.

These greater lifts are a disadvantage because they cause greater strains on the pile warp threads. Moreover, this greater lift also places greater strain on the retracting springs in the harness 5, and the jacquard machines are also under greater strain as a result.

The weaving speed or shot frequency of the weaving machine is adversely affected. The efficiency is also reduced.

Figure 6:
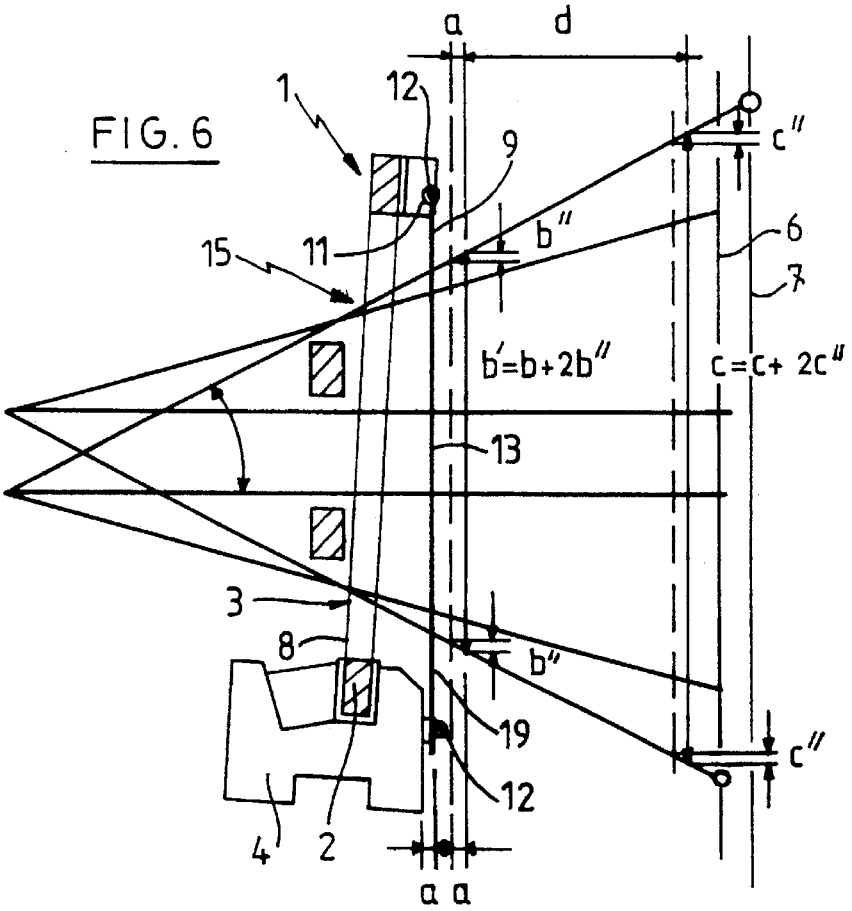
FIG. 6 is a diagrammatic arrangement of a loom reed indicating the space taken up by the installation of a deflector heald frame.

FIG. 6 shows the layout of a deflector heald frame. The top part 9 of each deflector heald is threaded by its eye 11 onto a rod. The bottom part 19 is held in place by a rod 12. As in the case of FIG. 5, FIG. 6 makes it clear that a shift a of the harness healds 6 for the installation of the deflector heald frame 15 increases the lifts on the harness healds from b to b'.

Figure 4:
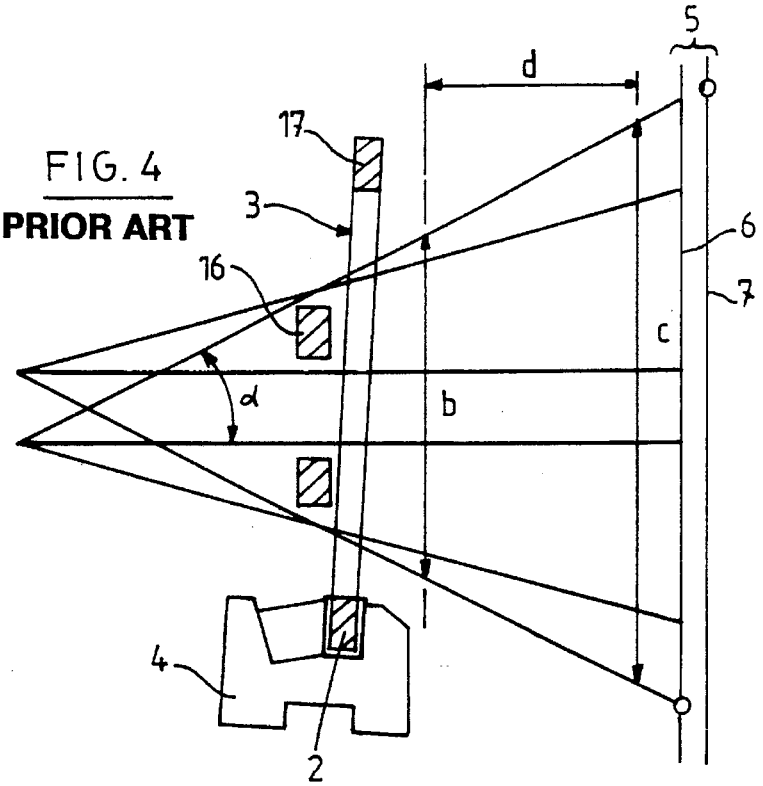
FIG. 4 PRIOR ART
FIG. 4 is a diagrammatic arrangement giving a view of the installation of a conventional loom reed without deflector heald frame.
Figure 7:
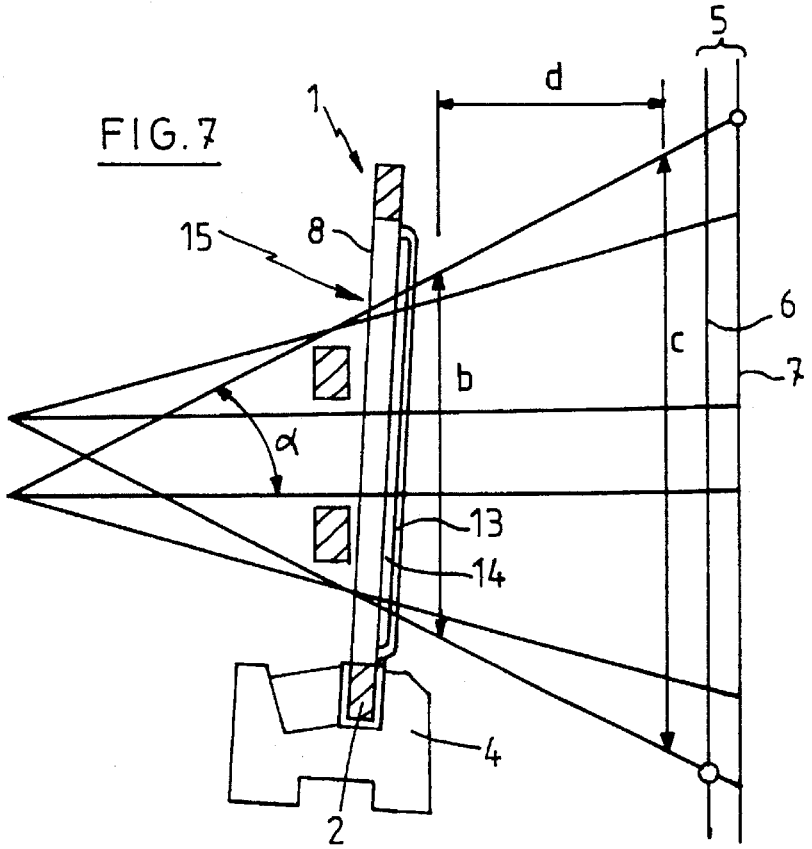
FIG. 7 shows a diagrammatic arrangement of a loom reed with inbuilt deflector heald frame according to the invention.

FIG. 7 shows a loom reed according to the invention, comprising a reed rail 2 of the same thickness as reed rail 2 of the conventional reed shown in FIG. 4. The reed dents consist of a number of parallel drop wires 3. The loom reed is fixed on a loom lay 4. At least one drop wire 3 consists of two parts 8, 13 which are parallel to each other. The front part 10 of the drop wire 3 fulfils the function of a conventional loom reed. The rear part 13 of the drop wire 3 is staggered parallel and laterally in a weft insertion direction relative to the front part 8 of the drop wire 3.

At least one drop wire 3 is provided with an elongated recess 14.

EXAMPLE 1

Figure 8:
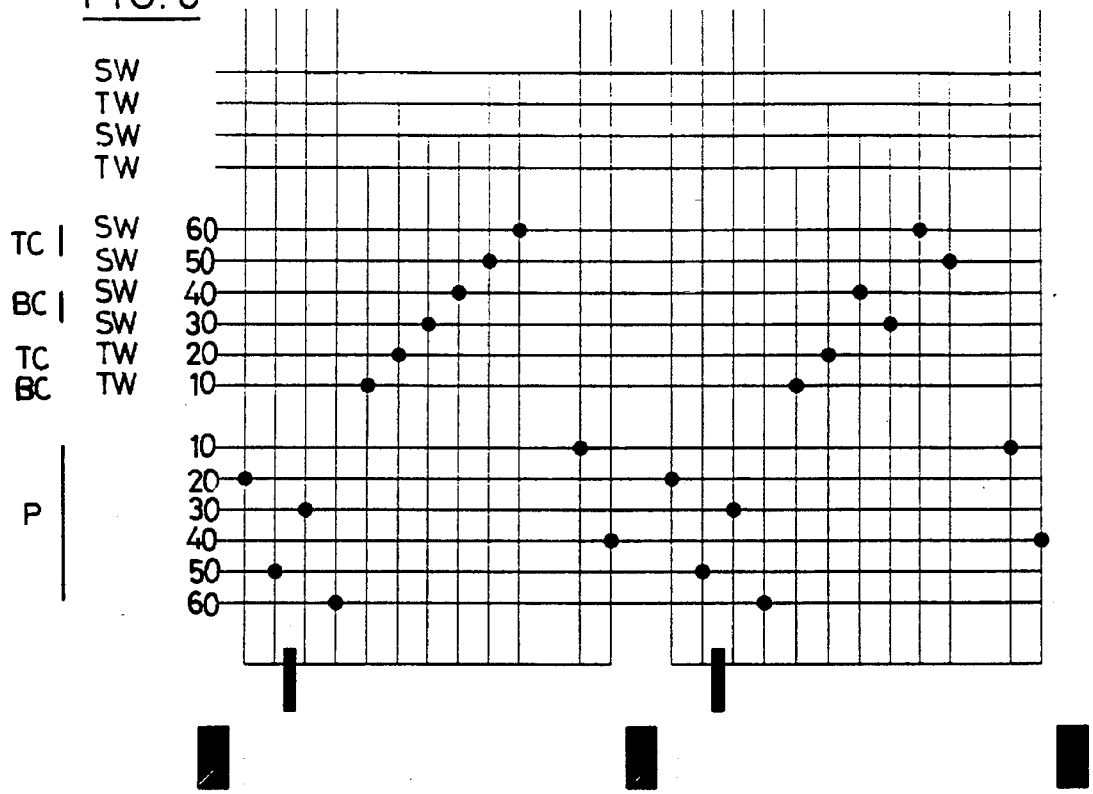
FIGS. 8 & 9 show two examples of threading-through with the use of a deflector heald frame according to the invention.

In a first example of threading-through making use of a one-part loom reed drop wire 3 with recess and staggering of rear part 13 or loom reed 1 with inbuilt deflector heald 15 according to the invention (see FIG. 8) it is possible to separate warp threads 20 and 30, which e.g. bind together in the top loom reed, and warp threads 50 and 60 (FIGS. 8 and 9) which e.g. bind together in the bottom fabric. This means that pile warp threads can no longer become entangled with one another.

EXAMPLE 2

Figure 9:
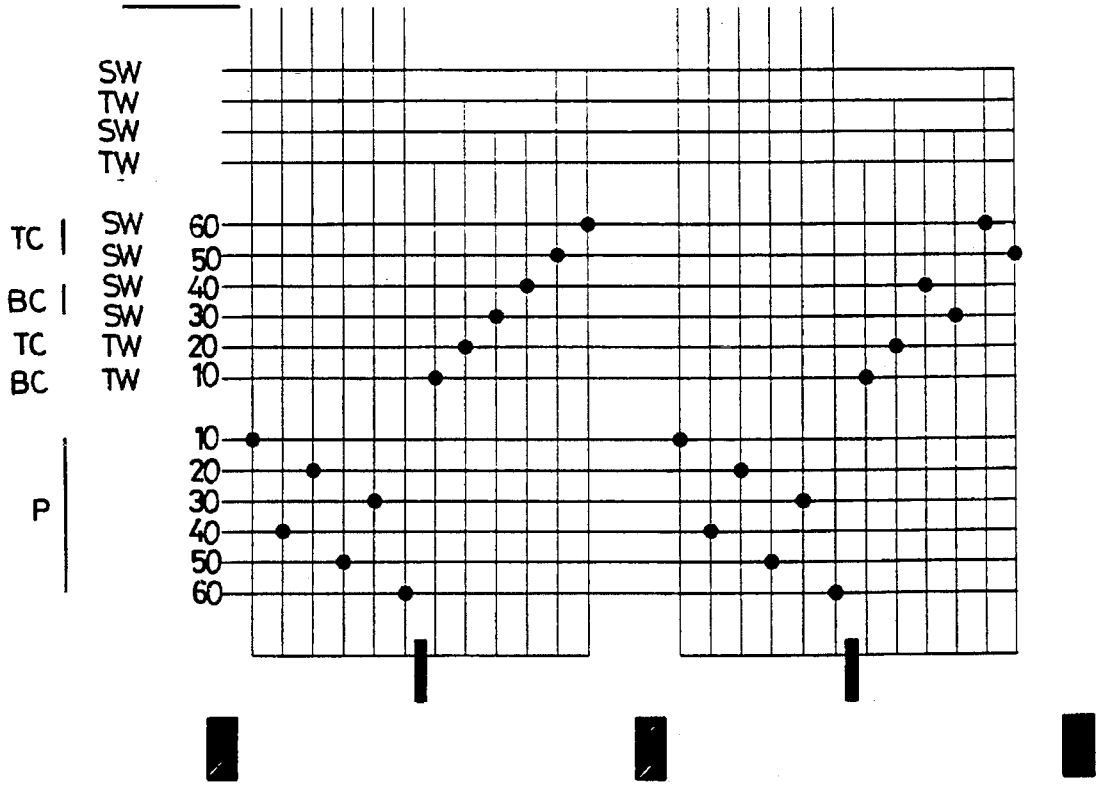

A second example of threading-through making use of a one-part drop wire 3 with recess and staggering of the rear part according to the invention is shown in FIG. 9. Pile warp threads and foundation warp threads are separated from each other here, so that pile warp threads and foundation warp threads can never lie intertwined on the back of the carpet, nor can they ever be bound in intertwined under the binding warp threads. The proposed threading-through gives a very neat rear aspect to the carpet, through the fact that the pile loops ultimately lie in a neat line between the binding warp threads.

It can be seen in FIG. 7 that reed rail 2 need not be thicker than reed rail 2 in FIG. 4 of a conventional loom reed, with the result that the loom reed can be installed in any face-to-face weaving loom or pile wire weaving loom, without changes to the loom lay 4.

The rear part 13 of the loom reed projects backwards towards the harness 5 and the distance is determined by the clamping profile of the lay. The harness 5 thus need no longer be moved backwards, which means that this loom reed can also be installed in existing weaving looms without modifying the harness 5.

I claim:

1. A loom reed with integral deflector heald frame in a face-to-face or a pile wire weaving-loom configured to prevent the weaving yarns running in the warp and weft directions from becoming entangled during the weaving of carpets and/or velvets, said reed including dents or drop wires, in order to separate a number of pile warp threads from each other, said loom reed having all dents or drop wires identical and made up of a front part and rear part, which are both parallel to the warp direction and laterally staggered or offset relative to one another in the weft direction.

2. The loom reed according to claim 1, wherein at least one of said drop wires or dents is provided with an elongated recess.

* * * * *